US011325813B2

(12) United States Patent
Hovi et al.

(10) Patent No.: US 11,325,813 B2
(45) Date of Patent: May 10, 2022

(54) METHOD FOR CONTROLLING AN ELEVATOR AND AN ELEVATOR

(71) Applicant: KONE Corporation, Helsinki (FI)

(72) Inventors: Antti Hovi, Helsinki (FI); Ari Kattainen, Helsinki (FI); Juha-Matti Aitamurto, Helsinki (FI)

(73) Assignee: KONE CORPORATION, Helsinki (FI)

( * ) Notice: Subject to any disclaimer, the term of this patent is extended or adjusted under 35 U.S.C. 154(b) by 483 days.

(21) Appl. No.: 16/457,097

(22) Filed: Jun. 28, 2019

(65) Prior Publication Data

US 2019/0322490 A1 Oct. 24, 2019

Related U.S. Application Data

(63) Continuation of application No. PCT/EP2017/082513, filed on Dec. 13, 2017.

(30) Foreign Application Priority Data

Dec. 29, 2016 (EP) ..... 16207343

(51) Int. Cl.
*B66B 13/22* (2006.01)
*B66B 5/00* (2006.01)
(Continued)

(52) U.S. Cl.
CPC ..... *B66B 13/22* (2013.01); *B66B 5/0031* (2013.01); *B66B 13/08* (2013.01); *B66B 13/146* (2013.01)

(58) Field of Classification Search
CPC ..... B66B 13/22; B66B 5/0031; B66B 13/08; B66B 13/146
See application file for complete search history.

(56) References Cited

U.S. PATENT DOCUMENTS

2006/0175135 A1 8/2006 Meissner et al.
2012/0118675 A1* 5/2012 Abad ..... B66B 1/32 187/288
(Continued)

FOREIGN PATENT DOCUMENTS

EP 0 455 919 A2 11/1991
JP 2008-156092 A 7/2008
(Continued)

OTHER PUBLICATIONS

International Search Report (PCT/ISA/210) issued in PCT/EP2017/082513, dated Mar. 16, 2018.
(Continued)

*Primary Examiner* — Jeffrey Donels
(74) *Attorney, Agent, or Firm* — Birch, Stewart, Kolasch & Birch, LLP

(57) ABSTRACT

An elevator includes a car with at least two car doors, each car door being provided with a door contact, a shaft being provided with corresponding landing doors, each landing door being provided with a door contact, each landing door opening in synchronism with the corresponding car door, the door contacts forming part of a safety circuit of the elevator, a car door contact input being connected to a middle point in the safety circuit between a series connection of the car door contacts and a series connection of the landing door contacts. A status information of the car door contact input is monitored in order to determine whether the door contacts are operational or not when the car doors are opened and/or closed with a predetermined time delay at a landing.

11 Claims, 6 Drawing Sheets

(51) Int. Cl.
*B66B 13/08* (2006.01)
*B66B 13/14* (2006.01)

(56) References Cited

U.S. PATENT DOCUMENTS

| | | | | |
|---|---|---|---|---|
| 2012/0186914 | A1 | 7/2012 | Birrer | |
| 2019/0002239 | A1* | 1/2019 | Zimmerli | B66B 13/22 |
| 2021/0101781 | A1* | 4/2021 | Roussel | B66B 5/0031 |

FOREIGN PATENT DOCUMENTS

| | | | |
|---|---|---|---|
| WO | WO 2004/096690 | A1 | 11/2004 |
| WO | WO 2011/054674 | A1 | 5/2011 |

OTHER PUBLICATIONS

Written Opinion (PCT/ISA/237) issued in PCT/EP2017/082513, dated Mar. 16, 2018.

* cited by examiner

METHOD FOR CONTROLLING AN ELEVATOR AND AN ELEVATOR

CROSS REFERENCE TO RELATED APPLICATIONS

This application is a Continuation of PCT International Application No. PCT/EP2017/082513, filed on Dec. 13, 2017, which claims priority under 35 U.S.C. 119(a) to Patent Application No. 16207343.1, filed in the Europe on Dec. 29, 2016, all of which are hereby expressly incorporated by reference into the present application.

FIELD OF THE INVENTION

The invention relates to a method for controlling an elevator and to an elevator. The elevator comprises a car with at least two car doors. Each car door comprises at least one door panel and each car door is provided with a door contact. The shaft is provided with corresponding landing doors. Each landing door comprises at least one door panel and each landing door is provided with a door contact. Each landing door opens in synchronism with the corresponding car door. The door contacts form part of a safety circuit of the elevator.

BACKGROUND ART

An elevator comprises typically a car, an elevator shaft, a machine room, lifting machinery, ropes, and a counter weight. The elevator car is positioned within a car frame that supports the car. The lifting machinery comprises a sheave, a machinery brake and an electric motor for rotating the traction sheave. The lifting machinery moves the car in a vertical direction upwards and downwards in the vertically extending elevator shaft. The ropes connect the car frame and thereby also the car via the sheave to the counter weight. The car frame is further supported with gliding means on guide rails extending in the vertical direction in the shaft. The gliding means can comprise rolls rolling on the guide rails or gliding shoes gliding on the guide rails when the elevator car is mowing upwards and downwards in the elevator shaft. The guide rails are supported with fastening brackets on the side wall structures of the elevator shaft. The gliding means engaging with the guide rails keep the car in position in the horizontal plane when the car moves upwards and downwards in the elevator shaft. The counter weight is supported in a corresponding way on guide rails supported on the wall structure of the shaft. The elevator car transports people and/or goods between the landings in the building. The elevator shaft can be formed so that the wall structure is formed of solid walls or so that the wall structure is formed of an open steel structure.

The car may comprise at least one car door and the shaft comprises corresponding landing doors. Each car door is operated by a door operator positioned on the car. The door operator comprises a motor connected to a suitable mechanical arrangement for moving the car door. A door coupler forms a mechanical coupling between the car door and the corresponding landing door. The door coupler comprises a first part in connection with the car door and a second part in connection the landing door. The landing door will move in synchronism with the car door when the two parts of the door coupler are connected.

The car may be provided with a car door only on one side of the car or the car may be a so called through-type car i.e. a car having a car door on at least two side walls of the car.

The doors in a through-type car are typically positioned on opposite side walls of the car i.e. there is a front door and a rear door, but this need not be the case. The car may e.g. be provided with three doors i.e. a door at each of three sides of the car in a case where the elevator is a so called rucksack elevator in which the two car guide rails are on the same side of the shaft. Each door comprises at least one door panel. The door may be a centre opening door or a side opening door.

The car door and the corresponding landing door may be provided with door contacts. The door contacts are part of the elevator safety circuit which is an array of switches, contacts and sensors distributed in the elevator shaft and the car to monitor the safety status of the elevator as a whole. The components in the safety circuit are coupled in series so that opening of one contact disrupts the whole safety circuit. The door contacts indicate the state closed or open of the respective door. A door contact is closed i.e. in a conducting stage, when the respective door is closed and open i.e. in a non-conducting state when the respective door is open. The safety circuit allows normal operation of the elevator only when the safety status of the elevator is "safe" i.e. the electric circuit comprising the safety switches, contacts and sensors is in a conductive state. In order for the safety status of the elevator to be "safe" it is required that all elevator doors are closed.

Bypassing an individual door contact, for example by a jumper wire may sometimes provide a shortcut in a maintenance task. However, there is a risk of a fatal accident or a serious injury in case the elevator car moves when one or more doors are not completely closed. Door contacts may also be vandalised for unauthorised entry to the car roof, for example. The door contacts are operational when they operate normally i.e. open when the corresponding door opens. The door contacts may be micro contacts, proximity sensors or equivalent sensors indicating the status of the door or the status of the lock of the door.

BRIEF DESCRIPTION OF THE INVENTION

An object of the present invention is to achieve an improved method for controlling an elevator and an improved elevator.

The elevator comprises a car with at least two car doors, each car door comprising at least one door panel and being provided with a door contact, a shaft being provided with corresponding landing doors, each landing door comprising at least one door panel and being provided with a door contact, each landing door opening in synchronism with the corresponding car door, the door contacts forming part of a safety circuit of the elevator.

The elevator comprises further a car door contact input connected to a middle point in the safety circuit between a series connection of the car door contacts and a series connection of the landing door contacts.

The method comprises monitoring a status information of the car door contact input in order to determine whether the door contacts are operational or not when the car doors are opened and/or closed with a predetermined time delay at a landing.

It is possible to detect whether the door contact of a car door and/or a door contact of the corresponding landing door is operational based on the status indication received from the car door contact input during the time delay. An operational door contact should open when the corresponding door opens. The status indication is received from the car door contact input being formed in a middle point between a series connection of the car door contacts and a series connection of the landing door contacts. The car door contact input will change state when either side of the car door contact input in the safety circuit opens. The state of the car door contact input may be indicated e.g. by a voltage of the car door contact input or by a voltage of the car door input in relation to a reference voltage or a ground voltage or by a resistance of the safety circuit etc.

The method may be used in an opening sequence of the car doors. Only one car door and the corresponding landing door may be opened first, and the remaining car doors and the corresponding landing doors may be opened after a predetermined time delay. A possible bypassing of the door contact of the car door and/or the door contact of the corresponding landing door may be detected based on the status indication received from the car door contact input during the predetermined time delay before the remaining car doors and corresponding landing doors are opened.

The method may also be used in a closing sequence of the car doors. All the other car doors and the corresponding landing doors except for the car door and the corresponding landing door that is to be tested are closed first. A possible bypassing of the door contact of the car door and/or the door contact of the corresponding landing door that are to be tested may be detected based on the status indication received from the car door contact input during the predetermined time delay before the car door and the corresponding landing door to be tested are closed.

The method may be used only when opening the car doors so that the opening sequence of the car doors is altered each time the car is to be stopped at a specific landing. Testing of the door contacts at a specific landing will thus need as many stops as there are doors in the car.

The method may on the other hand be used only when closing the car doors so that the closing sequence of the car doors is altered each time the car is to be stopped at a specific landing. Testing of the door contacts at a specific landing will thus need as many stops as there are doors in the car.

The method may further be used at each landing when opening the car doors and when closing the car doors. All contacts in a car with two doors can thus be tested at each stop at a landing.

The door contacts are operational when they operate normally i.e. open when the corresponding door opens. The door contacts are not operational when they are bypassed or when they are broken so that they remain closed when the corresponding door opens. The door contacts may be micro contacts, proximity sensors or equivalent sensors indicating the status of the door or the status of the lock of the door.

Immediately when the car door contact input indicates that a car door contact and/or corresponding landing door contact is bypassed, the elevator will be stopped as the safety status of the elevator is indefinite. A mechanic is in such case needed in order to sort out the cause of the problem.

BRIEF DESCRIPTION OF THE DRAWINGS

The invention will in the following be described in greater detail by means of preferred embodiments with reference to the attached drawings, in which.

DETAILED DESCRIPTION OF EMBODIMENTS OF THE INVENTION

Figure 1:
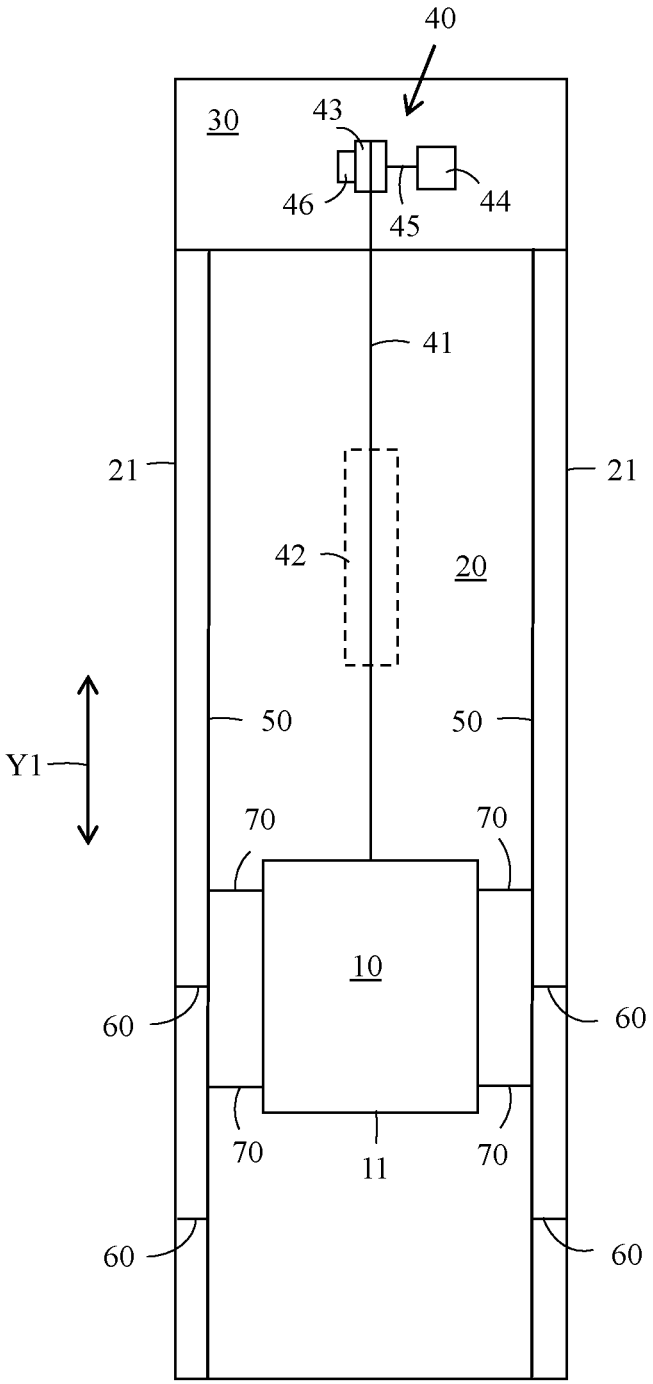
FIG. 1 shows a first vertical cross section of an elevator.

FIG. 1 shows a vertical cross section of an elevator. The elevator comprises a car 10, an elevator shaft 20, a machine room 30, lifting machinery 40, ropes 41, and a counter weight 42. A car frame 11 surrounds the car 10. The car frame 11 may be a separate frame or formed as an integral part of the car 10. The lifting machinery 40 comprises a sheave 43, a machinery brake 46 and an electric motor 44 for rotating the sheave 43 via a shaft 45. The lifting machinery 40 moves the car 10 in a vertical direction Y1 upwards and downwards in the vertically extending elevator shaft 20. The car frame 11 is connected by the ropes 41 via the sheave 43 to the counter weight 42. The car frame 11 is further supported with gliding means 70 at guide rails 50 extending in the vertical direction in the shaft 20. The figure shows two guide rails 50 at opposite sides of the car 10. The gliding means 70 can comprise rolls rolling on the guide rails 50 or gliding shoes gliding on the guide rails 50 when the car 10 is mowing upwards and downwards in the elevator shaft 20. The guide rails 50 are attached with fastening brackets 60 to the side wall structures 21 in the elevator shaft 20. The figure shows only two fastening brackets 60, but there are several fastening brackets 60 along the height of each guide rail 50. The gliding means 70 engaging with the guide rails 50 keep the car 10 in position in the horizontal plane when the car 10 moves upwards and downwards in the elevator shaft 20. The counter weight 42 is supported in a corresponding way on guide rails that are attached to the wall structure 21 of the shaft 20. The machinery brake 46 stops the rotation of the sheave 43 and thereby the movement of the elevator car 10. The car 10 transports people and/or goods between the landings in the building. The elevator shaft 20 can be formed so that the wall structure 21 is formed of solid walls or so that the wall structure 21 is formed of an open steel structure.

Figure 2:
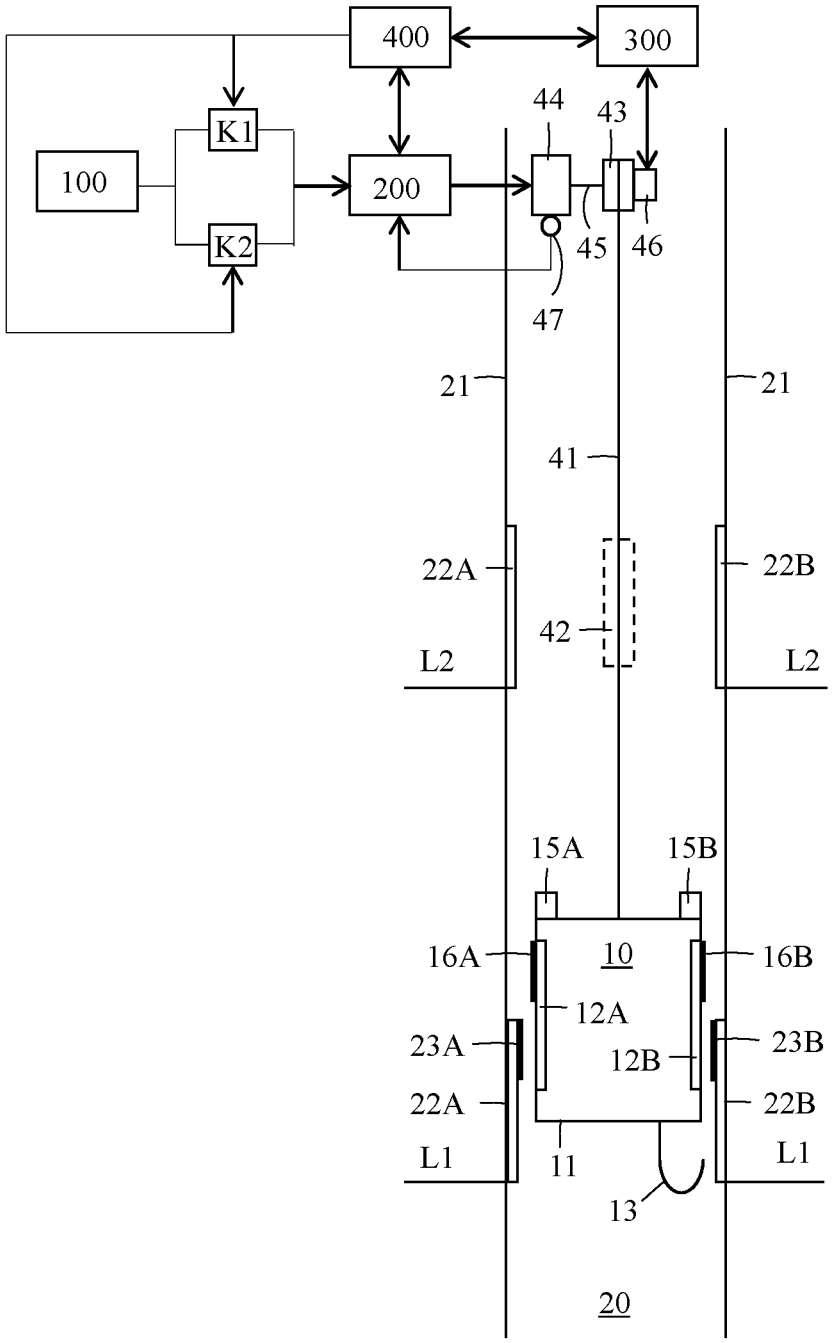
FIG. 2 shows a block diagram of the main parts in a control system of an elevator.

FIG. 2 shows a block diagram of the main parts in a control system of an elevator. The elevator car 10 is carried by the ropes 41, which connect the car 10 to the counter weight 42. The ropes 41 pass over the sheave 43. The sheave 43 is driven by the electric motor 44. The system comprises a machinery brake 46, a machinery brake control unit 300, a frequency converter 200, and a main control unit 400.

The frequency converter 200 is connected via two parallel connected contactors K1, K2 to the electrical grid 100. The contactors K1, K2 are part of the safety circuit of the elevator and they are controlled by the main control unit 400. The electric motor 44 is advantageously a permanent magnet synchronous motor 44. The frequency converter 200 controls the rotation of the electric motor 44. The rotation speed of the electric motor 44 is measured with a sensor 47, which is connected to the frequency converter 200. The frequency converter 200 also receives a rotational speed reference i.e. a target value of the rotational speed of the electric motor 44 from the main control unit 400.

The machinery brake control unit 300 is used to control the machinery brake 46 of the elevator. The machinery brake control unit 300 can e.g. be situated in connection with the control panel of the elevator or in connection with the main control unit 400 or in the vicinity of the machinery brake 46 or in connection with the electric motor 44.

The elevator car 10 positioned within the car frame 11 moves upwards and downwards in the shaft 20 between landings L1, L2 driven by the electric motor 44 and the sheave 43. The car 10 may be provided with a car door 12A, 12B only on one side wall of the car 10 or the car 10 can be a so called through-type car 10 i.e. a car 10 having a car door 12A, 12B on at least two side walls of the car 10. The car doors 12A, 12B in a through-type car 10 are typically positioned on opposite side walls of the car 10. This means that the car 10 is provided with a front door 12A and a rear door 12B. The car doors 12A, 12B could naturally be positioned on two adjacent side walls of the car 10. A through type car 10 may in a so called rucksack elevator be provided with three car doors i.e. a car door at three side walls of the car 10. The two guide rails 50 are in a rucksack elevator on the same side of the shaft 20.

The elevator car 10 in the figure may be called a through-type elevator car comprising a first car door 12A at the front side of the car 10 and a second car door 12B at the opposite, rear side of the car 10. The shaft 20 comprises a corresponding first landing door 22A at the front side of the shaft 20 and a second landing door 22B at the rear side of the shaft 20 at each landing L1, L2. The first car door 12A is operated by a first door operator 15A and the second car door 12B is operated by a second door operator 15B. The first door operator 15A and the second door operator 15B may both be positioned on the car 10. Each of the door operators 15A, 15B may comprise a motor connected via a mechanical coupling to the respective car door 12A, 12B in order to move the car door 12A, 12B. A first part 16A of a first two-part door coupler is positioned in connection with the first car door 12A and a second part 23A of the first two part door coupler is positioned in connection with the first landing door 22A. A first part 16B of a second two-part door coupler is positioned in connection with the second car door 12B and a second part 23B of the second two part door coupler is positioned in connection with the second landing door 22B. Each of the door couplers forms a mechanical coupling between the car door 12A, 12B and the respective landing door 22A, 22B. The landing door 22A, 22B will move in synchronism with the car door 12A, 12B when the two parts of the door coupler are connected. The movement of the car door 22A, 22B is transferred via the door coupler to the landing door 22A, 22B. There is a cable connection 13 between the elevator car 10 and the main control unit 400 in order to transmit information and commands from the elevator car 10 to the main control unit 400 and vice a versa.

Figure 3:
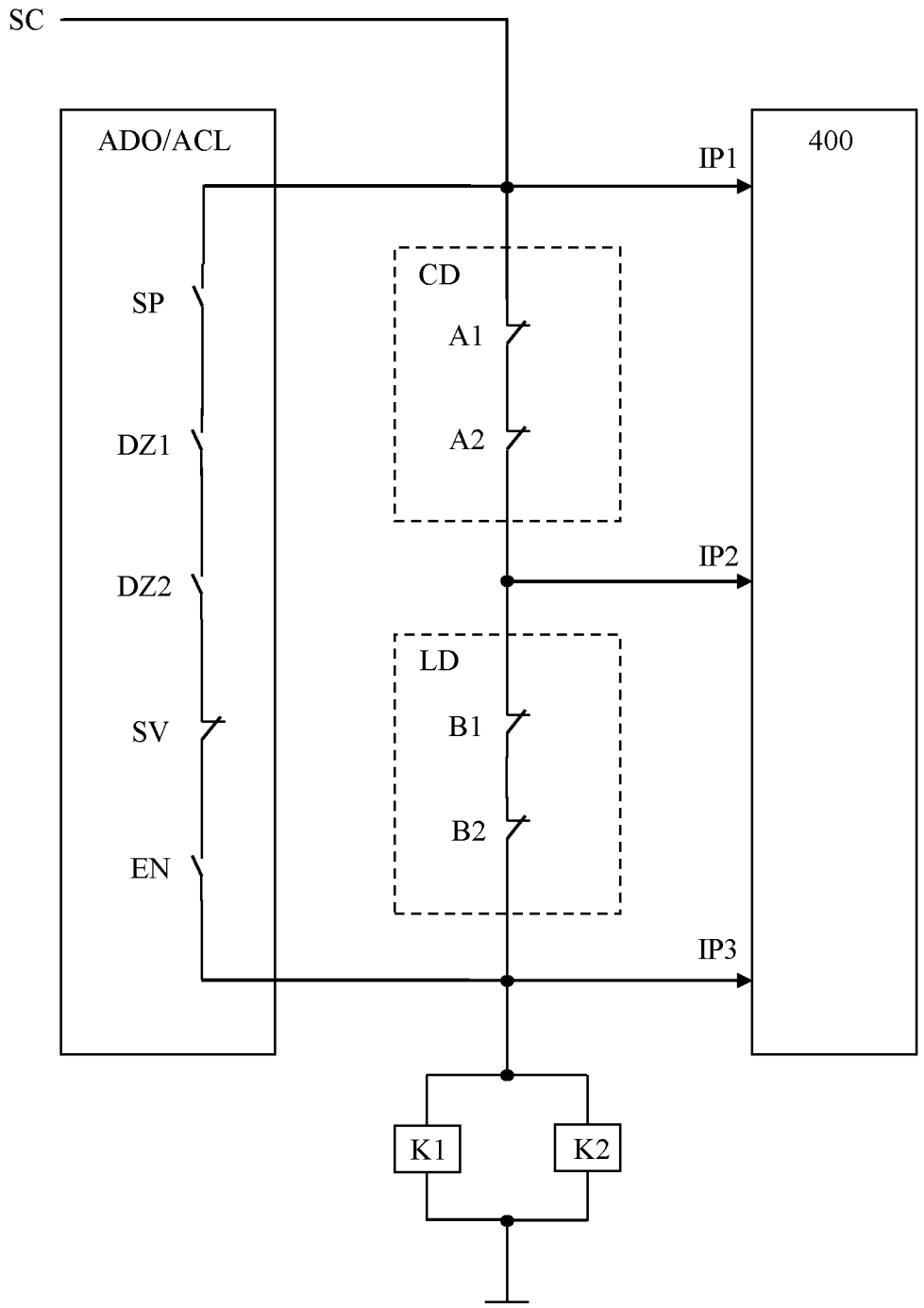
FIG. 3 shows a part of a safety circuit of an elevator according to a first embodiment of the invention.

FIG. 3 shows a part of a safety circuit of an elevator according to a first embodiment of the invention. The figure shows car door CD door contacts A1, A2 for two car doors 12A, 12B and landing door LD door contacts B1, B2 for the corresponding two landing doors 22A, 22B. All door contacts A1, A2, B1, B2 are connected in series in the safety circuit SC. The car 10 may be a through type car 10 comprising a front car door 12A provided with a front car door contact A1 and a rear car door 12B provided with a rear car door contact A2. The front landing door 22A is provided with a landing front door contact B1 and the rear landing door 22B is provided with a landing rear door contact B2.

The figure shows further an advance door opening ADO and an accurate levelling ACL circuit ADO/ACL comprising an ADO/ACL speed signal SP, an ADO/ACL enable signal EN, a first door zone signal DZ1, a second door zone signal DZ2, and a supervision signal SV. The figure shows further the elevator logic controller 400.

The upper end of the ADO/ACL circuit is connected to the elevator logic controller 400 as a stop contact input IP1. The lower end of the ADO/ACL circuit is connected to the elevator logic controller 400 as a shaft door contact input IP3. A middle point between the series connected car door CD door contacts A1, A2 and the series connected landing door LD door contacts B1, B2 is connected to the elevator logic controller 400 as a car door contact input IP2.

The ADO/ACL circuit is used to enable advance door opening when the car 10 approaches a landing L1, L2. The ADO/ACL circuit bypasses the car door contacts CD and the landing door contacts LD during advance door opening. This means that the opening of the car doors 12A, 12B can start already before the car 10 has stopped at the landing L1, L2. The door contacts A1, A2 of the car doors 12A, 12B and the door contacts B1, B2 of the landing doors 22A, 22B will open immediately when the car door 12A, 12B and thereby the corresponding landing door 22A, 22B starts to open, but the ADO/ACL circuit will bypass the door contacts A1, A2, B1, B2 and keep the safety circuit SC closed during the advance opening of the car doors 12A, 12B and the corresponding landing doors 22A, 22B.

The first door zone DZ1 is a wider zone extending above and below a landing L1, L2. The second door zone DZ2 is a narrower zone extending above and below a landing L1, L2. When the elevator car 10 approaches a landing L1, L2 from above or from below, then the first door zone signal DZ1 will first be turned on and then the second door zone signal DZ2.

The speed signal SP is set to be on when the speed of the car 10 is below a predetermined value.

The ADO/ACL enable signal EN is set to be on when the aim is that the car 10 should stop on said landing L1, L2.

The supervision signal SV is set on when all targets in the elevator that are supervised fulfil the predefined conditions.

When the elevator car 10 approaches a landing L1, L2, which is determined from the door zone signals DZ1, DZ2 and when the speed of the car 10 is low, which is determined from the speed signal SP and when the supervision signal SV is on and when the ADO/ACL enable signal EN is on, then the door contacts A1, A2 of the car doors 12A, 12B and the door contacts B1, B2 of the landing doors 22A, 22B are bypassed with the ADO/ACL circuit. This means that advance opening of the car door and the landing door can be started already before the car 10 stops at the landing L1, L2.

An opening sequence at a landing L1, L2 may comprise two steps. The first step comprises opening only the front car door 12A and the corresponding front landing door 22A first. When the front car door 12A and the corresponding front landing door 22A starts to open, then the door contacts A1, B1 of the front car door 12A and the corresponding front landing door 22A opens. This means that the car door contact input IP2 will change state, which is seen by the elevator logic controller 400. It is thus possible to make sure that the door contacts A1, B1 of the front car door 12A and/or the corresponding front landing door 22A is not bypassed or broken. The car door contact input IP2 will not change state if the door contacts A1, B1 of the front car door 12A and/or the corresponding front landing door 22A is bypassed or broken.

The second step in the opening sequence is started after a predetermined time delay by opening the rear car door 12B and the corresponding rear landing door 22B. There is no possibility at this stage to detect whether the door contact A2 of the rear car door 12B and/or the door contact B2 of the corresponding rear landing door 22B is bypassed or broken. This is due to the fact that the door contact A1 of the front car door 12A and the door contact B1 of the corresponding front landing door 22A is already open. Detection of a possible bypassing of the door contact A2 of the rear car door 12B and/or the door contact B2 of the corresponding rear landing door 22B may be done at the next stop of the car 10 at the landing L1, L2. The opening sequence of the front doors 12A, 22A and the rear doors 12B, 22B can be reversed at the next stop at the landing L1, L2 so that the rear doors 12B, 22B are opened first. A possible bypassing of the door contact A2 of the rear car door 12A and/or of the door contact B2 of the corresponding rear lading door 22B can then be detected.

The use of the predetermined time delay between the opening of the front car door 12A and the rear car door 12B makes it possible to detect a possible bypassing of the door contact A1 of the front car door 12A and/or of the door contact B1 of the corresponding front landing door 22A.

Alternatively, the door contacts A1, B1 of the front doors 12A, 22A and the door contacts A2, B2 of the rear doors 12B, 22B can be tested in a closing sequence. The first step in the closing sequence comprises closing the front car door 12A and the corresponding front landing door 22A. The second step in the closing sequence comprises closing the rear car door 12B and the corresponding rear landing door 22B after a predetermined time delay has passed. The door contacts A2, B2 of the rear car door 12B and the rear landing door 22B should be open when said doors 12B, 22B are open. The state of the car door contact input IP2 should reflect this i.e. the state of the car door contact input IP2 should not change when the front car door 12A and the corresponding front landing door 22A are closed. The car door contact input IP2 will change state when the front car door 12A and the corresponding front landing door 22A are closed if the door contacts A2, B2 of the rear car door 12B and/or the corresponding rear landing door 22B are bypassed or broken. The state of the car door contact input IP2 should change only after the second step when the rear car door 12B and the corresponding rear landing door 22B are closed indicating that the door contacts A2, B2 of the rear car door 12B and the rear landing door 22B are closed.

Hence for a through-type car with two doors 12A, 12B, 22A, 22B, the car doors 12A, 12B and the landing doors 22A, 22B can be tested during one stop. The car door contacts A1, B1 of the front car door 12A and the corresponding front landing door 22A can be tested in an opening sequence and the door contacts A2, B2 of the rear car door 12B and the corresponding rear landing door 22B can be tested in a closing sequence.

Figure 4:
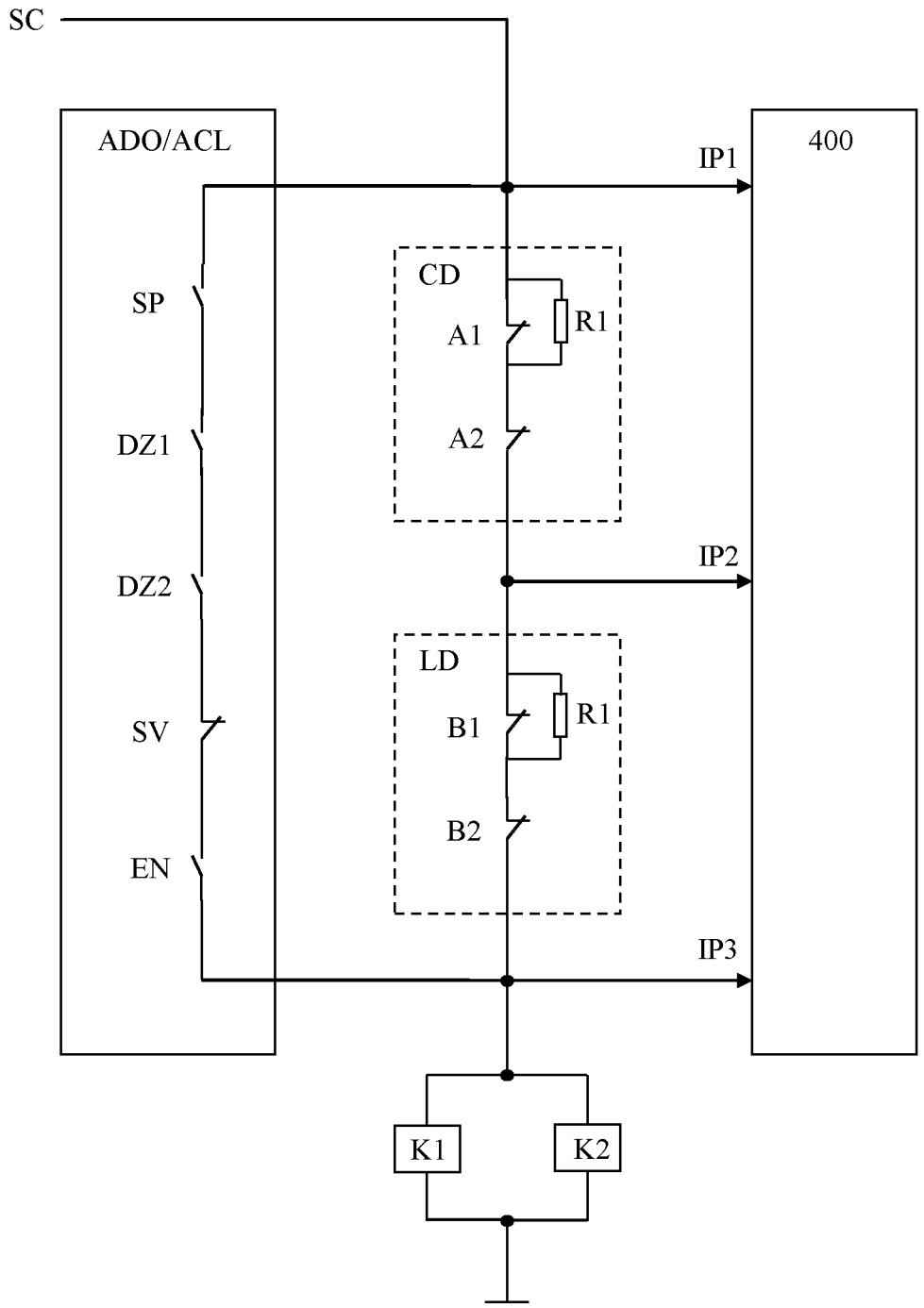
FIG. 4 shows a part of a safety circuit of an elevator according to a second embodiment of the invention.

FIG. 4 shows a part of a safety circuit of an elevator according to a second embodiment of the invention. This embodiment differs from the first embodiment in that the door contact A1 of the front car door 12A and the door contact B1 of the front landing door 22A is provided with a parallel connected resistor R1 having a resistance in the order of kilo ohms. The resistance of the resistor R1 may be 20 kohm.

A possible bypassing of the door contacts A1, A2 of the car doors 12A, 12B and the door contacts B1, B2 of the landing doors 22A, 22B can also in this case be detected by the change in the status of the car door contact input IP2. A resistance seen from the car door contact input IP2 equalling to the resistance of the resistor R1 during the time when only the front car door 12A is open means that the door contact A1 of the front car door 12A and/or the door contact B1 of the corresponding landing door 22A are not bypassed. An infinite resistance during the time when both car doors 12A, 12B are opened means that the door contact A2 of the rear car door 12B and/or the door contact B2 of the corresponding rear landing door 22B are not bypassed.

Figure 5:
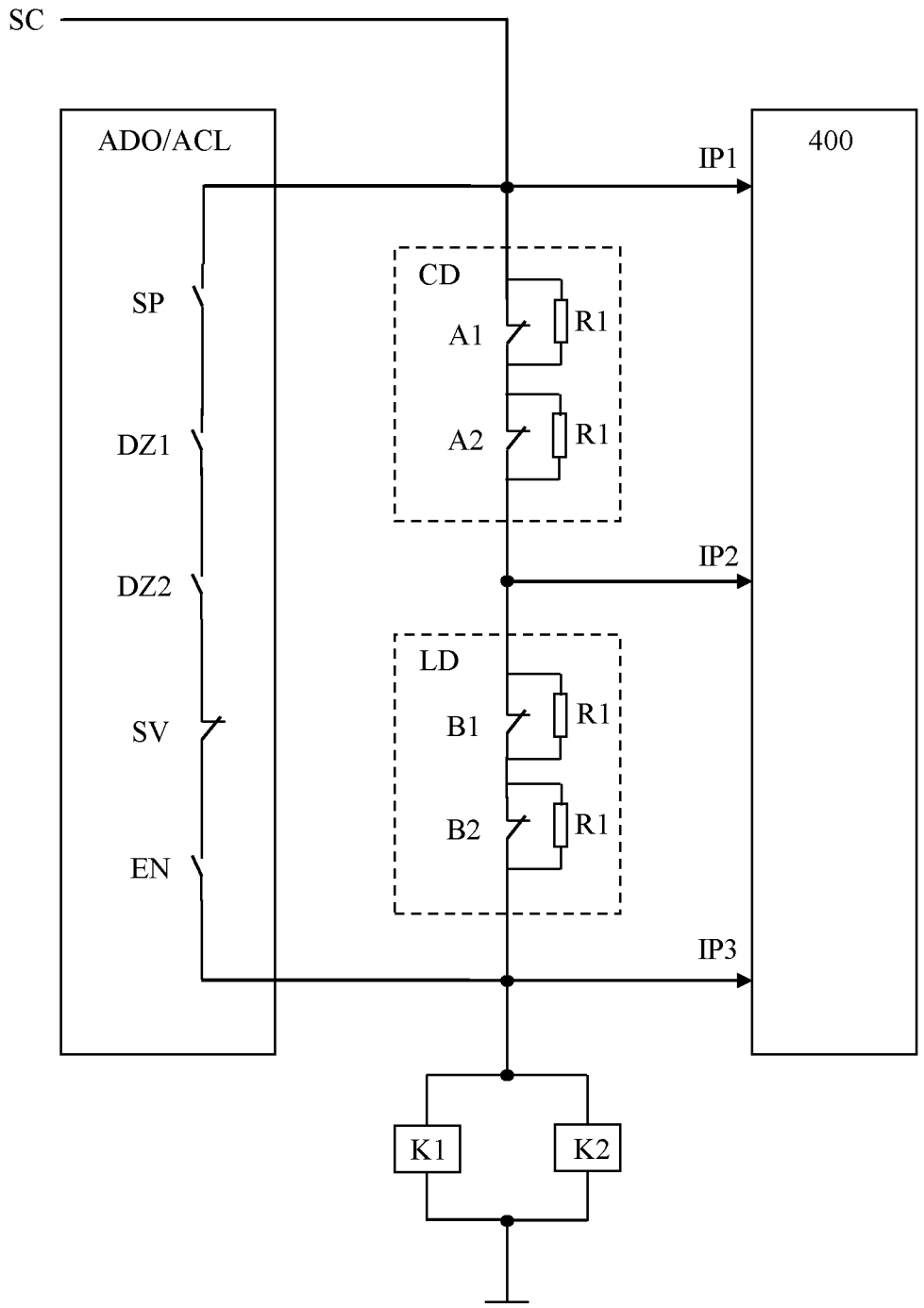
FIG. 5 shows a part of a safety circuit of an elevator according to a third embodiment of the invention.

FIG. 5 shows a part of a safety circuit of an elevator according to a third embodiment of the invention. This embodiment differs from the second embodiment in that each of the door contacts A1, A2 of the car doors 12A, 12B and each of the door contacts B1, B2 of the landing doors 22A, 22B is provided with a parallel connected resistor R1 having a resistance in the order of kilo ohms. The resistance of the resistor R1 may be 20 kohm.

A possible bypassing of the door contacts A1, A2 of the car doors 12A, 12B and the door contacts B1, B2 of the landing doors 22A, 22B can also in this case be detected by the change in the status of the car door contact input IP2. A resistance seen from the car door contact input IP2 equalling to the resistance of the resistor R1 during the time when only the front car door 12A is open means that the door contact A1 of the front car door 12A and/or the door contact B1 of the front landing door 22A are not bypassed. A resistance equalling to two times the resistance of the resistor R1 during the time when both car doors 12A, 12B are opened means that the door contact A2 of the rear car door 12B and/or the door contact B2 of the rear landing door 22B are not bypassed.

The status of the car door contact input IP2 can in FIGS. 4 and 5 be a voltage of the car door contact input IP2, a voltage of the car door contact input IP2 in relation to a reference voltage or a ground potential or a resistance measured from the car door contact input IP2.

Figure 6:
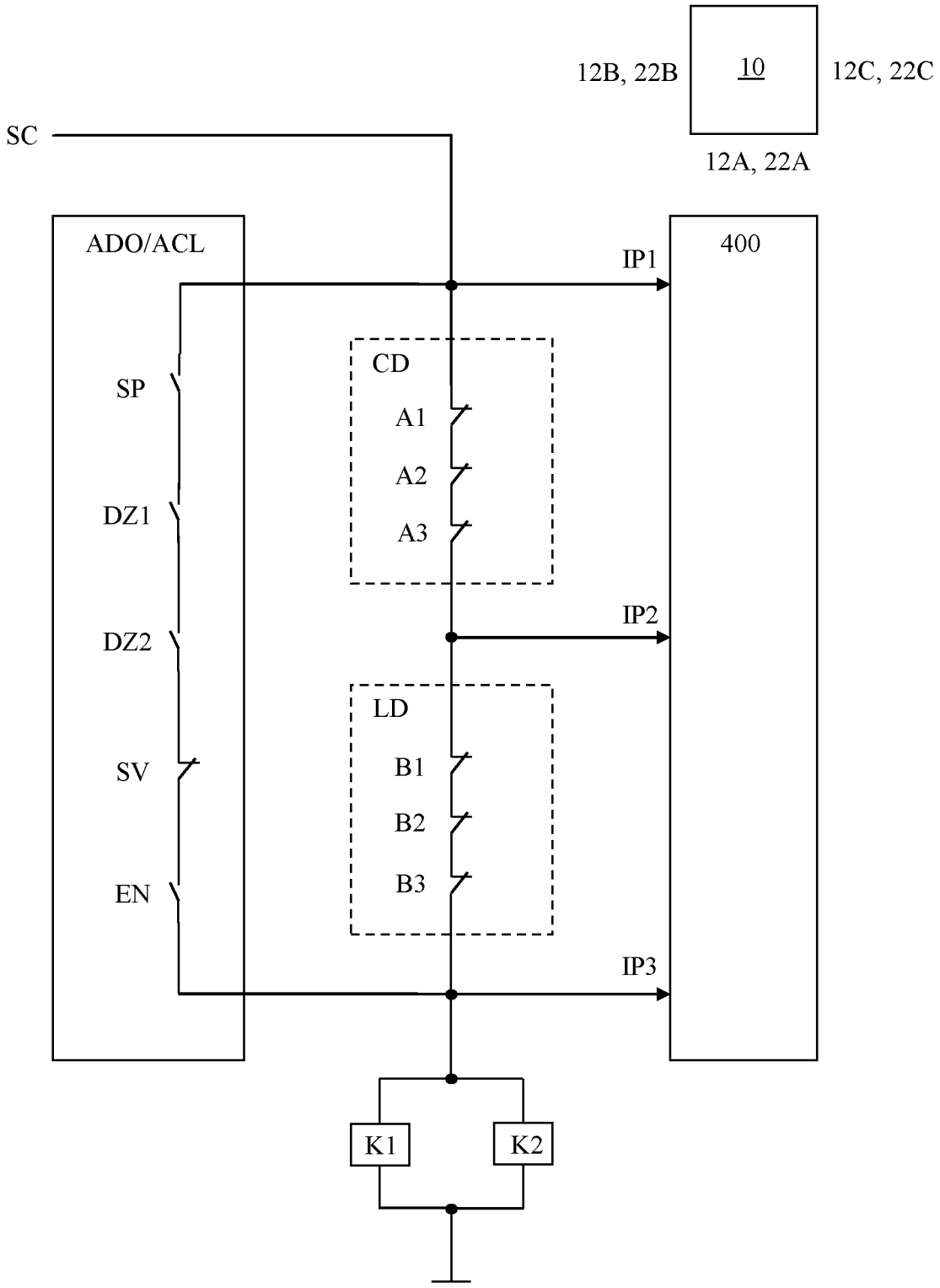
FIG. 6 shows a part of a safety circuit of an elevator according to a fourth embodiment of the invention.

FIG. 6 shows a part of a safety circuit of an elevator according to a fourth embodiment of the invention. The figure shows a car 10 with three car doors 12A, 12B, 12C and three corresponding landing doors 22A, 22B, 22C. There are thus three door contacts A1, A2, A3 in the car door CD unit and three door contacts B1, B2, B3 in the landing door LD unit. The invention can also be used in an elevator car 10 provided with three car doors 12A, 12B, 12C.

The opening sequence can be done in the following way:

upon a first stop of the car (10) at a specific landing (L1, L2), opening only a first car door (12A) and thereby the corresponding landing door (22A) and, after a predetermined time delay has passed, opening the remaining car doors (12B, 12C) and thereby the corresponding landing doors (22B, 22C), determining during the predetermined time delay whether the door contact (A1) of the first car door (12A) and/or the door contact (B1) of the corresponding landing door (22A) is/are operational based on the status information received from the car door contact input (IP2), upon a second stop of the car (10) at said landing (L1, L2), opening only a second car door (12B) and thereby the corresponding landing door (22B) and, after a predetermined time delay has passed, opening the remaining car doors (12A, 12C) and thereby the corresponding landing doors (22A, 22C), determining during the predetermined time delay whether the door contact (A2) of the second car door (12B) and/or the door contact (B2) of the corresponding landing door (22B) is/are operational based on the status information received from the car door contact input (IP2), upon a third stop of the car (10) at said landing (L1, L2), opening only a third car door (12C) and thereby the corresponding landing door (22C) and, after a predetermined time delay has passed, opening the remaining car doors (12A, 12B) and thereby the corresponding landing doors (22A, 22B), determining during the predetermined time delay whether the door contact (A3) of the third car door (12C) and/or the door contact (B3) of the corresponding landing door (22C)

is/are operational based on the status information received from the car door contact input (IP2).

The closing sequence can be done in the following way:

upon a first stop of the car (10) at a specific landing (L1, L2) closing the second and the third car door (12B, 12C) and the corresponding landing doors (22B, 22C), and after a predetermined time delay closing the first car door (12A) and the corresponding landing door (22A), and determining during the predetermined time delay whether the door contact (A1) of the first car door (12A) and/or the door contact (B1) of the corresponding landing door (22A) is operational based on the status indication received from the car door contact input (IP2), upon a second stop at said landing (L1, L2) closing the first and the third car door (12A, 12C) and the corresponding landing doors (22A, 22C), and after a predetermined time delay closing the second car door (12B) and the corresponding landing door (22B), and determining during the predetermined time delay whether the door contact (A2) of the second car door (12B) and/or the door contact (B2) of the corresponding landing door (22B) are operational based on the status indication received from the car door contact input (IP2), upon a third stop at said landing (L1, L2) closing the first and the second car door (12A, 12B) and the corresponding landing doors (22A, 22B), and after a predetermined time delay closing the third car door (12C) and the corresponding landing door (22C), and determining during the predetermined time delay whether the door contact (A3) of the third car door (12C) and/or the door contact (B3) of the corresponding landing door (22C) is operational based on the status indication received from the car door contact input (IP2).

The opening of the doors that are not to be tested at each stop in the opening sequence are preferably done so that all doors that are not to be tested are opened simultaneously.

The opening sequence can naturally be done in any desired order. The door to be opened first at the first stop at a specific landing can be any of the doors in the car.

The closing of the doors that are not to be tested at each stop in the closing sequence are preferably done so that all doors that are not to be tested are closed simultaneously.

The closing sequence can naturally be done in any desired order. The door to be tested i.e. closed after the predetermined time delay at the first stop at a specific landing can be any of the doors in the car.

FIGS. 2-5 show an elevator car 10 having a front car door 12A and an opposite rear car door 12B. The invention can naturally be used in an elevator car 10 provided with a first car door 12A on a first side wall and a second car door 12B on an adjacent second side wall.

FIG. 6 shows an elevator car 10 with three car doors 12A, 12B, 12C. The invention can naturally be used in connection with a car 10 having any number of car doors 12A, 12B, 12C i.e. at least two car doors.

The figures show an elevator provided with an ADO/ACL circuit, but the invention can also be used in an elevator without an ADO/ACL circuit. This means that advance opening of the car doors 12A, 12B, 12C is not used. The car doors 12A, 12B, 12C will is such case start to open only when the car 10 has stopped at the landing L1, L2. The car door contact input IP2 will also in this case indicate whether the door contacts A1, A2, A3, B1, B2, B3 of the car door 12A, 12B, 12C and the landing door 22A, 22B, 22C that opened first are operational when the predetermined time delay is used between the opening of the car doors 12A, 12B, 12C. The same applies to the closing of the car doors 12A, 12B, 12C.

The use of the invention is naturally not limited to the type of elevator disclosed in FIG. 1. The invention can be used in any type of elevator e.g. also in elevators lacking a machine room and/or a counterweight. The counterweight could be positioned on either side wall or on both side walls or on the back wall of the elevator shaft. The sheave, the machine brake and the motor could be positioned in the machine room or somewhere in the elevator shaft.

The invention can be applied in connection with any type of elevator car doors and landing doors. The car doors could thus be sliding doors with one or several door panels. The landing doors could also be sliding doors with one or several panels or they could be swing doors.

It will be obvious to a person skilled in the art that, as the technology advances, the inventive concept can be implemented in various ways. The invention and its embodiments are not limited to the examples described above but may vary within the scope of the claims.

The invention claimed is:

1. A method for controlling an elevator comprising a car with at least two car doors, each car door comprising at least one door panel and being provided with a door contact, a shaft being provided with corresponding landing doors, each landing door comprising at least one door panel and being provided with a door contact, each landing door opening in synchronism with the corresponding car door, the door contacts forming part of a safety circuit of the elevator, a car door contact input being connected to a middle point in the safety circuit between a series connection of the car door contacts and a series connection of the landing door contacts, the method comprising:

monitoring a status information of the car door contact input in order to determine whether the door contacts are operational or not when the car doors are opened and/or closed with a predetermined time delay at a landing, such that upon a stop of the car at a landing, opening only the car door and thereby the corresponding landing door that are to be tested and, after the predetermined time delay has passed, opening the remaining car doors and thereby the corresponding landing doors; and determining during the predetermined time delay whether the door contacts of the car door and the corresponding landing door that are to be tested are operational based on the status information received from the car door contact input;

or upon a stop of the car at a landing closing first all the car doors and corresponding landing doors except for the car door and the corresponding landing door that are to be tested, whereby the car door and the corresponding landing door that are to be tested are closed after a predetermined time delay; and determining during the predetermined time delay whether the door contacts of the car door and the corresponding landing door that are to be tested are operational based on the status indication received from the car door contact input.

2. The method according to claim 1, further comprising:

changing the car door to be opened first during consecutive stops at the landing, whereby as many consecutive stops as there are car doors are needed at the landing in order to test all door contacts at the landing.

3. The method according to claim 1, further comprising:
changing the car door to be closed after the time delay during consecutive stops at the landing, whereby as many consecutive stops as there are car doors are needed at the landing in order to test all door contacts at the landing.

4. The method according to claim 1, the elevator car comprising two car doors, the method comprising:
opening a first car door and the corresponding landing door first and opening a second car door and the corresponding landing door after the predetermined time delay; and
determining during the predetermined time delay whether the door contacts of the first car door and the corresponding landing door are operational based on the status information received from the car door contact input.

5. The method according to claim 4, further comprising:
opening the first car door and the corresponding landing door first at each second time when the elevator car is to be stopped at a specific landing and opening the second car door and the corresponding landing door first at the remaining times when the elevator car is to be stopped at the same landing.

6. The method according to claim 1, the elevator car comprising two car doors, the method comprising:
closing the first car door and the corresponding landing door first and closing the second car door and the corresponding landing door after the predetermined time delay; and
determining during the predetermined time delay whether the door contacts of the second car door and landing door pair are operational based on the status indication received from the car door contact input.

7. The method according to claim 4, further comprising:
opening the first car door and the corresponding landing door first and closing the first car door and the corresponding landing door first each time the car stops at a landing, whereby determination of whether the door contacts of the first car door and the corresponding landing door and door contacts of the second car door and the corresponding landing door are operational can be tested at each stop.

8. The method according to claim 1, whereby the door contacts of the first car door and the corresponding landing door are provided with a parallel connected resistor having a resistance in the order of kilo ohms, the method comprising:
determining whether the door contacts of the car door and the corresponding landing door are operational by monitoring the status of the car door contact input, whereby a first status responsive to the resistance of the resistor during the time when only the first car door and the corresponding landing door are open means that the door contacts of the first car door and the corresponding landing door are operational and a second status responsive to an infinite resistance during the time when both car doors and the corresponding landing doors are opened means that the door contacts of the second car door and the corresponding landing door are operational.

9. The method according to claim 1, whereby each of the door contacts of the car door and the corresponding landing door are provided with a parallel connected resistor having a resistance in the order of kilo ohms, the method comprising:
determining whether the door contacts of the car doors and the corresponding landing doors are operational by monitoring the status of the car door contact input, whereby a first status responsive to the resistance of the resistor during the time when only the first car door and the corresponding landing door are open means that the door contacts of the first car door and the corresponding landing door are operational and a second status responsive to a resistance equaling two times the resistance of the resistor during the time when both car door and the corresponding landing door are opened means that the door contacts of the second car door and the corresponding landing door are operational.

10. An elevator comprising:
a car with at least two car doors, each car door comprising at least one door panel and being provided with a door contact;
a shaft being provided with corresponding landing doors, each landing door comprising at least one door panel and being provided with a door contact, each landing door opening in synchronism with the corresponding car door, the door contacts forming part of a safety circuit of the elevator; and
a car door contact input connected to a middle point in the safety circuit between a series connection of the car door contacts and a series connection of the landing door contacts, whereby a status information of said car door contact input is monitored in order to determine whether the door contacts are operational or not when the car doors are opened and/or closed with a predetermined time delay at a landing,
wherein a controller of the elevator is configured to:
upon a stop of the car at a landing, open only the car door and thereby the corresponding landing door that are to be tested and, after the predetermined time delay has passed, open the remaining car doors and thereby the corresponding landing doors; and
determine during the predetermined time delay whether the door contacts of the car door and the corresponding landing door that are to be tested are operational based on the status information received from the car door contact input;
or
upon a stop of the car at a landing close first all the car doors and corresponding landing doors except for the car door and the corresponding landing door that are to be tested, whereby the car door and the corresponding landing door that are to be tested are closed after a predetermined time delay; and
determine during the predetermined time delay whether the door contacts of the car door and the corresponding landing door that are to be tested are operational based on the status indication received from the car door contact input.

11. The method according to claim 6, further comprising:
opening the first car door and the corresponding landing door first and closing the first car door and the corresponding landing door first each time the car stops at a landing, whereby determination of whether the door contacts of the first car door and the corresponding landing door and the door contacts of the second car door and the corresponding landing door are operational can be tested at each stop.

* * * * *